United States Patent [19]

Shima et al.

[11] 4,394,536

[45] Jul. 19, 1983

[54] SOUND REPRODUCTION DEVICE

[75] Inventors: Kenji Shima; Masahiro Hibino, both of Amagasaki, Japan

[73] Assignee: Mitsubishi Denki Kabushiki Kaisha, Tokyo, Japan

[21] Appl. No.: 272,548

[22] Filed: Jun. 11, 1981

[30] Foreign Application Priority Data

Jun. 12, 1980 [JP] Japan ..... 55-80367

[51] Int. Cl.[3] ..... H04R 5/00

[52] U.S. Cl. ..... 179/1 G; 179/1 GP

[58] Field of Search ..... 179/1 G, 1 GP, 1 GQ

[56] References Cited

U.S. PATENT DOCUMENTS 4,219,696 8/1980 Kogure et al. ..... 179/1 GP X
4,308,423 12/1981 Cohen ..... 179/1 G
4,329,544 5/1982 Yamada ..... 179/1 G X

FOREIGN PATENT DOCUMENTS 53-116102 10/1978 Japan ..... 179/1 GP

*Primary Examiner*—R. J. Hickey
*Attorney, Agent, or Firm*—Staas & Halsey

[57] ABSTRACT

A sound reproducing device adapted to be operated in a narrow space such as the passenger compartment of an automobile including a voltage amplifying or attenuating circuit for varying a difference signal between stereophonic right and left signals and a filter circuit. The voltage amplifying or attenuating circuit and filter circuit are provided in a circuit which produces a reverberation effect and an acoustic spreading effect for reproduced sound to decrease the closed-room effect. Each of these circuits is provided with a varible resistor, wherein the listener can vary the reverberation and acoustic spreading effects as desired.

8 Claims, 3 Drawing Figures

SOUND REPRODUCTION DEVICE

BACKGROUND OF THE INVENTION

The present invention relates to sound reproducing devices for producing stereophonic sound in narrow spaces, such as the passenger compartment of an automobile. More particularly, the invention relates to an improved sound reproducing device of this general type in which the stereo effect is enhanced.

When the listener listens to sound from such a sound reproducing device in the passenger compartment of an automobile, he feels as if the sound is coming from a narrow room. This is the so-called "closed-room effect". Furthermore, in the passenger compartment of an automobile, the listener is near the the loudspeakers so that he hears sound coming directly from the loudspeakers. That is, he hears the sound as if he were near the sound source. This increases the closed-room effect even more.

Therefore, heretofore, in order to eliminate the above-described problems, signals having frequency components in middle and high sound frequency ranges, which give a high directional effect, were applied mutually to the opposite channels to decrease the directional effect and to thereby increase the acoustic spreading effect. In each channel, a signal obtained by delaying frequency components in a high range are applied to provide a reverberation effect, thereby to reduce the closed-room effect.

A conventional sound reproducing device which utilizes the above-described reverberation and spreading effects will be described with reference to FIG. 1.

In FIG. 1, reference character 1L designates an input terminal to which is applied a signal L (left) in a two-channel stereo system, 1R an input terminal to which is applied a signal R (right), 2 an addition circuit in which a signal $-R$ which is obtained by inverting the phase of the signal R is added to the signal L, 3 a filter circuit, 4 a voltage amplifying or attenuating circuit for changing the amplitude of the signal $L-R$ which has passed through the filter circuit 3, 5 an addition circuit in which the output of the circuit 4 (i.e. a signal $L_1-R_1$) is added to the signal L from the input terminal 1L to output a signal $L+L_1-R_1$, 6 an addition circuit in which a signal obtained by inverting the phase of the output signal $L_1-R_1$ from the circuit 4 is added to the signal R from the input terminal 1R to output a signal $R+R_1-L_1$, 7 a high-pass filter circuit, 8 a phase shift or delay circuit, 9 an addition circuit in which the output signal $L+L_1-R_1$ from the addition circuit 5 is added to the output signal $L_2-R_2$ from the phase shift or delay circuit 8 to provide a signal $L+L_1^-+L_2-R_1-R_2$, and 10 an addition circuit in which a signal obtained by inverting the phase of the output signal $L_2-R_2$ from the circuit 8 is added to the output signal $R+R_1-L_1$ from the addition circuit 6 to output a signal $R+R_1+R_2-L_1-L_2$.

Further in FIG. 1, reference character 11L designates a power amplifier circuit for the signal $L+L_1+L_2-R_1-R_2$, 11R a power amplifier circuit for the signal $R+R_1+R_2-L_1-L_2$, and 12L and 12R left and right loudspeakers, respectively. In FIG. 1, the signs (+) and (−) beside the addition circuits 2, 5, 6, 9 and 10 are intended to mean direct addition of a signal without phase inversion, and addition of a signal after its phase has been inverted, respectively.

As is apparent from FIG. 1, the two channel signals in the circuit are symmetrical. That is, when either of the two signals passes to the channel opposite to its own, its phase is inverted, but when it returns to its own channel, the phase is restored.

The operation of the above-described circuitry for providing the reverberation and spreading effects will be described.

The phase of the signal R applied to the input terminal 1R is inverted and the inverted signal is added to the signal L from the input terminal 1L in the addition circuit 2, as a result of which a difference signal component $L-R$, representing the difference between the right and left channel signals, is provided. The amplitude of the signal $L-R$, after the signal passes through the filter circuit 3, is set to a suitable value by the voltage amplifying or attenuating circuit 4. The difference signal component $L-R$ includes a relatively large amount of reverberation component. This reverberating component is extracted by the addition circuit 2. From the reverberation component, the difference signal $L_1-R_1$ having a frequency component in a range of about 100 Hz to 1.2 KHz, to which the ear is especially sensitive, is filtered by the filter circuit 3 where a frequency component which produces a stronger reverberation effect is emphasized by a resonance circuit in the filter circuit 3. The signal $L_1-R_1$ is added to the signal L in the addition circuit 5. Furthermore, the signal $L_1-R_1$ is added to the signal R in the addition circuit 6 after its phase has been inverted. As a result, a reverberation effect and, especially, an acoustic spreading effect are provided by the sound from the loudspeakers 12L and 12R.

Next, the signal $L_1-R_1$ having a relatively large reverberation component, after passing through the circuit 4, is applied to the high-pass filter circuit 7, which is adapted to damp a low frequency component, where a signal component in a relatively high frequency range and having a strong directional effect is extracted. The signal thus extracted is applied to the phase shift or delay circuit 8 where it is subjected to phase inversion or time delay to provide a signal $L_2-R_2$. The signal $L_2-R_2$ is added to the signal $L+L_1-R_1$ in the addition circuit 9 and added to the signal $R+R_1-L_1$ in the addition circuit 10 after its phase has been inverted. Because of the phase inversion and the time delay, an acoustic spreading effect and, especially, a reverberation effect are produced by the sound from the loudspeakers 12L and 12R.

As is apparent from the above description, the directional effect is suppressed to enhance the acoustic spreading effect of sound emanated from the loudspeakers. Phase inversion or time delay is used to increase the reverberation effect to thereby decrease the closed-room effect.

However, it should be noted that, in the conventional sound reproducing device, the reverberation effect and the acoustic spreading effect are fixedly set and accordingly cannot be varied by the listener to suit his individual preferences.

SUMMARY OF THE INVENTION

An object of the invention is thus to eliminate the above-described difficulties accompanying a conventional sound reproducing device. More specifically, an object of the invention is to provide a sound reproducing device in which the reverberation effect and the acoustic spread effect can be freely varied by the listener as desired.

The foregoing object and other objects of the invention have been achieved by the provision of a sound reproducing device in which means for extracting the difference signal between stereophonic right and left signals is provided with a variable resistor to allow the listener to vary the reverberation effect and the acoustic spreading effect.

The nature, principle and utility of the invention will become more apparent from the following detailed description read in conjunction with the accompanying drawings.

DESCRIPTION OF THE PREFERRED EMBODIMENTS

Figure 1:
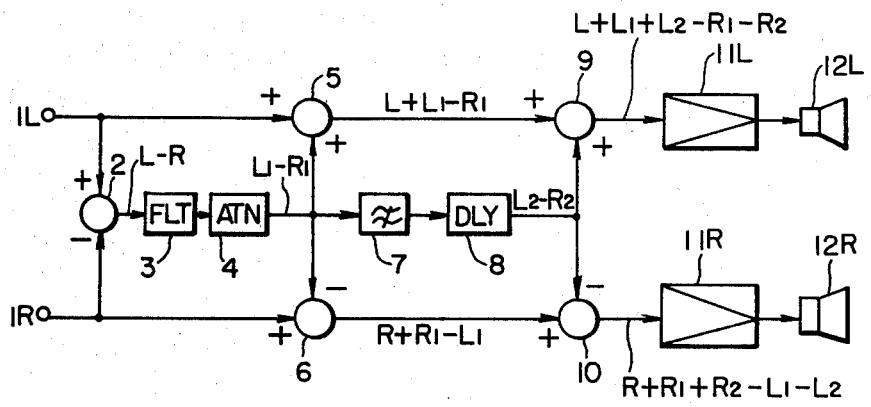
FIG. 1 is a block diagram of a conventional sound reproducing device which is operated in a narrow space such as the passenger compartment of an automobile.

A block diagram of a sound reproducing device constructed according to the invention is similar to that in FIG. 1, and the fundamental operation thereof is also similar to that of the above-described conventional sound reproducing device. However, the sound reproducing device of the invention differs from the conventional device in that variable resistors are provided in the filter circuit 3 and the voltage amplifying or attenuating circuit 4 in FIG. 1, respectively. The variable resistors in the circuits 3 and 4 can be operated simultaneously.

Figure 2:
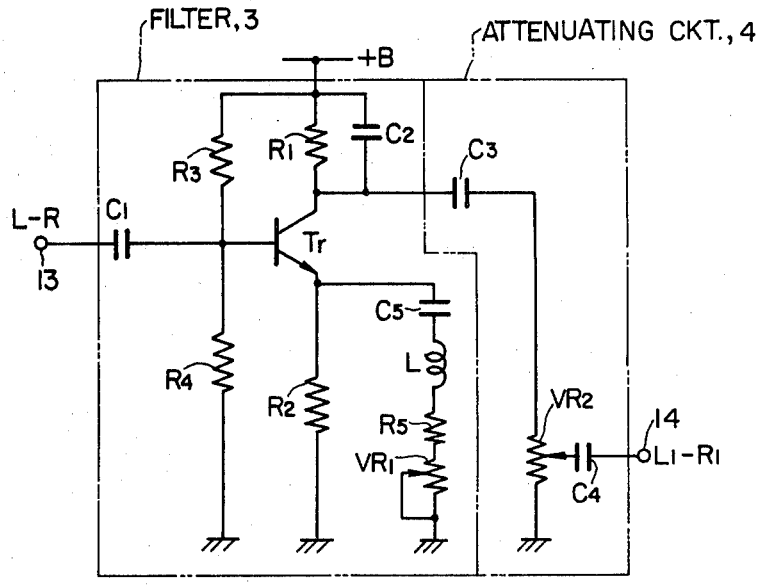
FIG. 2 is a circuit diagram showing an example of a filter circuit and a voltage amplifying or attenuating circuit which are employed in a sound reproducing device according to the invention.

FIG. 2 shows an embodiment of the invention in which variable resistors are provided in the filter circuit 3 and the voltage amplifying or attenuating circuit 4.

In FIG. 2, reference character 13 designates the input terminal of the filter circuit 3 which receives the signal L−R from the addition circuit 2 (FIG. 1); 14 the output terminal of the circuit 4 to which the signal $L_1-R_1$ is applied; Tr an NPN transistor; $R_1$, $R_2$ and $R_3$ and $R_4$ the collector resistor of the transistor Tr, the emitter resistor of the transistor Tr, and biasing resistors of the transistor Tr, respectively; $C_1$, $C_3$ and $C_4$ coupling capacitors for blocking direct current; $C_2$ a capacitor for decreasing a high frequency gain; L a coil; $C_5$ a capacitor forming a series resonance circuit with the coil L; $R_5$ a resistor for setting a ratio Q of reactance to resistance to a suitable value; $VR_1$ a variable resistor provided for the filter circuit 3; and $VR_2$ a variable resistor for the voltage amplifying or attenuating circuit 4. Operation of the variable resistor $VR_1$ changes the ratio Q and simultaneously changes the gain as a whole. Operation of the variable resistor $VR_2$ varies the afore-mentioned reverberation effect and acoustic spreading effect.

In FIG. 2, the filter circuit 3 is made up of the capacitors $C_1$, $C_2$ and $C_5$, the coil L, the resistors $R_1$ through $R_4$ and the variable resistor $VR_1$, while the circuit 4 is made up of the capacitors $C_3$ and $C_4$ and the variable resistor $VR_2$. The gain of the filter circuit may be determined by dividing the impedance of the resistor $R_1$ and the capacitor $C_2$, which are provided on the collector side of the transistor Tr, by the impedance which is obtained by combining the emitter resistor $R_2$ connected to the emitter of the transistor Tr and an impedance in parallel with the emitter resistor $R_2$.

Figure 3:
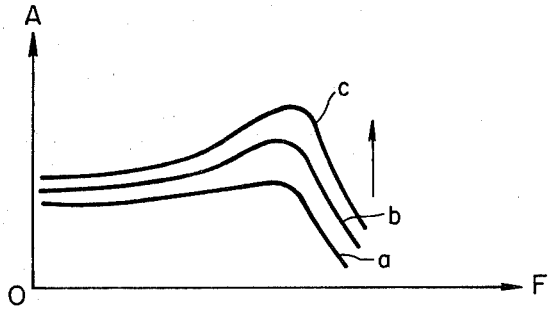
FIG. 3 is a graphical representation indicating variations of the characteristic of the filter circuit when a variable resistor provided, according to the invention, therein is operated.

FIG. 3 is a graphical representation indicating variations of the output (A) characteristic of the filter circuit 3 as a function of frequency F for various values of resistance set by the variable resistor $VR_1$. Sometimes it is desirable that the resistances of the variable resistors $VR_1$ and $VR_2$ be varied together. It is clear that if the wiper contact of the variable resistor $VR_2$ is set completely at the ground end, the aforementioned effects cannot be obtained at all. As the resistance of the variable resistor $VR_1$ is decreased, the characteristic of the filter circuit is changed from (a) to (b), from (b) to (c), and so forth as indicated by the arrow in FIG. 3.

With the sound reproducing device in which the filter circuit 3 and the voltage amplifying or attenuating circuit 4 are provided as described above according to the invention, the reverberation effect and the acoustic spreading effect can be varied by the listener as desired.

What is claimed is:

1. A sound reproducing device operatively connectable to first and second loudspeakers and to receive a stereo signal including left and right signals, comprising:

first main signal path circuit means for transmitting a first one of the left and right signals of the stereo signal to the first loudspeaker;

second main signal path circuit means for transmitting a second one of the right and left signals of the stereo signal to the second loudspeaker;

means for producing a difference signal equal to the difference between the right and left signals;

means for varying said difference signal to produce a varied difference signal;

first addition means for adding the varied difference signal to said first one of the left and right signals in said first main signal path circuit means;

second addition means for adding a signal whose phase is opposite to the phase of said varied by difference signal to said second one of the left and right signals in said second main signal path circuit means;

means for phase shifting said varied difference signal to produce a phase shifted varied difference signal;

third addition means for adding said phase shifted varied difference signal to said first one of the left and right signals in said first main signal path circuit means; and fourth addition means for adding to said second one of the left and right signals in said second main signal path circuit means a signal whose phase is opposite to the phase of said phase shifted varied difference signal.

2. The device as claimed in claim 1, wherein said means for varying comprises: a filter circuit and a voltage amplitude varying circuit operatively coupled to said filter circuit.

3. The device as claimed in claim 2, wherein said difference signal is coupled to be varied by said voltage amplitude varying circuit.

4. The device as claimed in claim 3, wherein said voltage amplitude varying circuit comprises a variable resistor.

5. The device as claimed in claim 3, wherein said filter circuit and said voltage amplitude varying circuit each comprise a variable resistor.

6. The device as claimed in claim 4, wherein resistances of said variable resistors of said filter circuit and said voltage amplitude varying circuit are varied simultaneously.

7. The device as claimed in claim 2, wherein said voltage amplitude varying circuit comprises an attenuating circuit.

8. The device, operatively connectable to a voltage source, as claimed in claim 2, 3, 4, 5, 6, or 7, wherein said means for varying further comprises:

a first capacitor having a first terminal coupled to receive said difference signal and a second terminal;

first and second resistors coupled in series between said voltage source and ground, a junction point between said first and second resistors being coupled to the second terminal of said first capacitor;

a transistor having a base coupled to said junction point, a collector and an emitter;

a third resitor coupled between said voltage source and the collector of said transistor;

a fourth resistor coupled between the emitter of said transistor and ground;

a second capacitor coupled in parallel with said third resistor;

a third capacitor having a first terminal coupled to the emitter of said transistor and a second terminal;

an inductor having a first terminal coupled to the second terminal of said third capacitor and a second terminal;

a fifth resistor having a first terminal coupled to the second terminal of said inductor and a second terminal;

said variable resistor of of said filter circuit having a first terminal coupled to the second terminal of said fifth resistor and second terminal coupled to ground;

a fourth capacitor having a first terminal coupled to the collector of said transistor and a second terminal;

said variable resistor of said voltage amplitude varying circuit having a first end terminal coupled to the second terminal of said fourth capacitor, a second end terminal coupled to ground and a wiper terminal; and a fifth capacitor having a first terminal coupled to the wiper terminal of said variable resistor of said voltage amplitude varying circuit and a second terminal, said difference signal which has been varied by said means for varying being provided at the second terminal of said fifth capacitor.

* * * * *